US006537019B1

(12) United States Patent
Dent

(10) Patent No.: US 6,537,019 B1
(45) Date of Patent: Mar. 25, 2003

(54) FAN ASSEMBLY AND METHOD

(75) Inventor: David E. Dent, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/588,861

(22) Filed: Jun. 6, 2000

(51) Int. Cl.[7] ..... F04D 29/38

(52) U.S. Cl. ..... 415/61; 415/19; 415/47; 415/66; 415/68; 416/39; 416/128; 417/2; 417/12; 417/244; 417/423.5; 417/426; 361/687; 361/695; 454/184

(58) Field of Search ..... 415/60–61, 66–69, 415/47–50, 19; 416/39, 120, 128–129, 198 R, 201 A; 417/2, 12, 244, 423.5, 426; 361/687, 694, 695; 454/104

(56) References Cited

U.S. PATENT DOCUMENTS 2,981,464 A * 4/1961 Omohundro ..... 415/68
4,767,262 A * 8/1988 Simon ..... 415/60
5,504,650 A * 4/1996 Katsui et al. ..... 361/697
5,546,272 A * 8/1996 Moss et al. ..... 361/687
5,772,500 A * 6/1998 Harvey et al. ..... 454/184
6,198,245 B1 * 3/2001 Du et al. ..... 361/695
6,266,243 B1 * 7/2001 Tomioka ..... 361/695

FOREIGN PATENT DOCUMENTS

DE 2017583 A * 11/1971 ..... 416/129
DE 3432439 A1 * 8/1985 ..... 416/129
DE 3814612 A1 * 11/1989 ..... 416/198 R

* cited by examiner

*Primary Examiner*—Christopher Verdier
(74) *Attorney, Agent, or Firm*—Marger, Johnson & McCollom P.C.

(57) ABSTRACT

A fan assembly includes a first fan and a second fan. The first fan has a first housing and a first blade assembly. The first blade assembly includes a plurality of blades attached to a hub, and is configured to rotate about a first axis of rotation in a first direction. The second fan includes a second housing and a second blade assembly. The second blade assembly also includes a plurality of blades attached to a hub. The second blade assembly, however, is configured to rotate about a second axis of rotation in a second direction that is opposite the first direction of rotation. The first axis of rotation and the second axis of rotation can be coincidental or they can be slightly offset.

6 Claims, 3 Drawing Sheets

FAN ASSEMBLY AND METHOD

BACKGROUND OF THE INVENTION

This invention relates generally to fans for creating a flow of air. More specifically, this invention relates to a fan assembly that uses multiple fans to supply the flow of air to an environment, for example, to a computer system for cooling.

Conventional computer platforms generally use axial fans to transfer air from outside a computer housing to inside the housing to cool an environment containing electronic components of the computer platform. Many axial fan systems include two or more fans connected in parallel (side by side) to provide additional cooling to the system and to provide redundancy in case one of the fans should fail. These parallel fan assemblies, however, are not configured to provide a maximized volume of air flow to a targeted area. Some coaxial (or series) fan assemblies have also been provided with fans that rotate in a common rotational direction to provide cooling for larger computer platforms. Unfortunately, these series fan assemblies also have not maximized a volume of air flow through the fan assembly. Prior art series fan assemblies also fail to provide efficient redundancy features.

In other fields, counter-rotating coaxial boat propellers have been provided to enable additional thrust to aquatic vehicles. These coaxial propellers may also provide some level of redundancy. Counter-rotating, coaxial boat propellers, however, relate to a different field of use and a different fluid medium and have not been adapted for use in fan assemblies for creating an air flow.

DETAILED DESCRIPTION

The fan assemblies and methods of this invention are primarily designed for, but are not limited to, computer cooling systems. These fan assemblies can be used in any application where the principles of this invention would be beneficial. Furthermore, although the following description discusses air as the subject flow medium, the flow of any other gas could also be controlled by this invention.

With respect to the use of counter-rotating serial fans to cool computer platforms, these fan assemblies and methods provide several benefits. One benefit of counter-rotating serial fans is additional cooling or staged cooling. Counter-rotating serial fans produce a greater volume of air flow than serial fans with blades that rotate in a common direction. Although this concept is somewhat similar to counter-rotating propellers in aquatic vehicles, the design considerations are quite different. Particularly, the fluid medium is significantly different for aquatic vehicle propellers than for cooling fans, and the objectives (thrust versus cooling) are also different. Staged cooling refers to the ability to operate one of the two fans while the other fan is turned off, to provide a lesser degree of cooling than when both fans are operated together. According to this invention, therefore, the on and off times of one or both of the fans can be controlled to control an amount of cooling within the system.

Another main benefit of this invention is more efficient redundancy. According to this invention, if one fan fails, the other fan can continue to operate to cool the system. Furthermore, when designed according to the principles of this invention, the failure of one fan will not greatly deteriorate the overall cooling performance of the fan assembly. It should be noted, however, that the most efficient redundancy is provided when the second fan fails rather than the first fan. This is because axial fans are generally better at pushing air than pulling air and because the first fan usually has a less restricted air inlet than the second fan.

Figure 1:
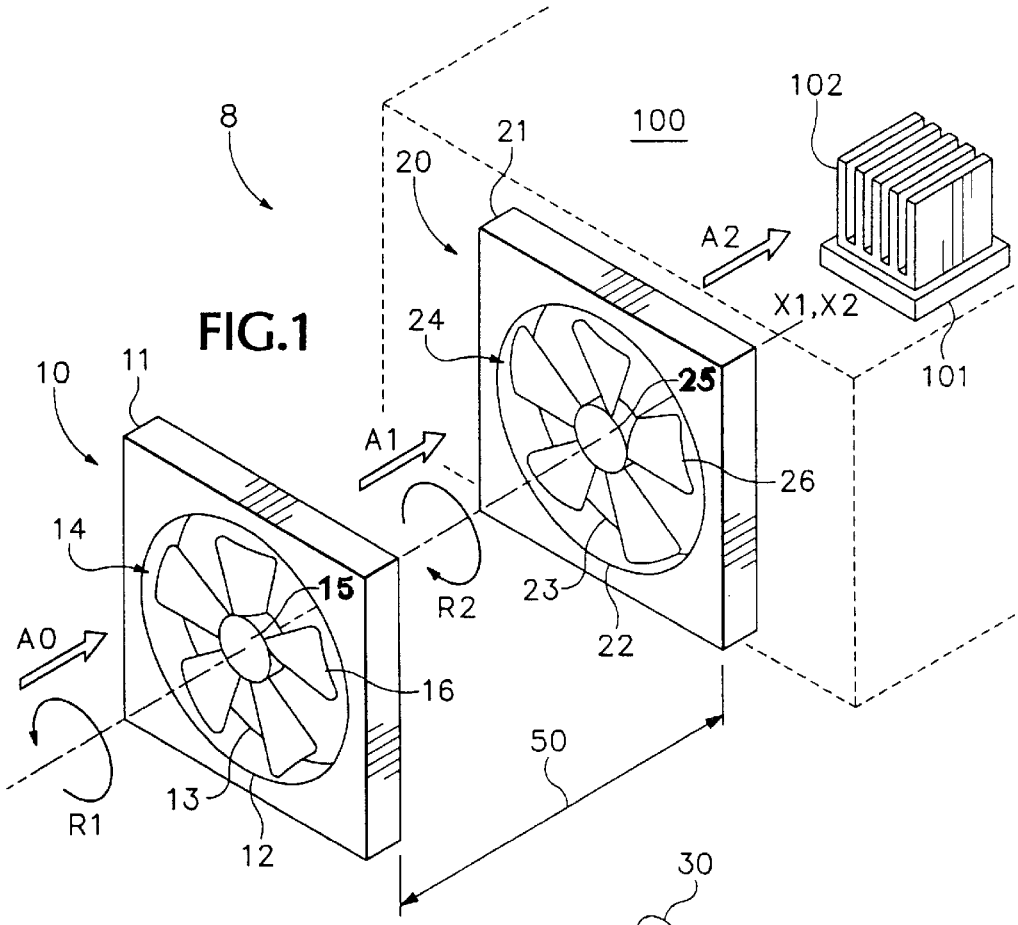
FIG. 1 is a somewhat schematic perspective view of a counter-rotating coaxial fan assembly having a first fan and a second fan according to a first embodiment of the present invention.

FIG. 1 is a somewhat schematic perspective view of a counter-rotating coaxial fan assembly 8 according to a first embodiment of the present invention. Referring to FIG. 1, a fan assembly 8 according to this invention includes a first fan 10 and a second fan 20. The first fan 10 is configured to receive air, represented by arrow A0, into an air inlet 12 and to output the air, represented by arrow A1, through an air outlet 13 to the second fan 20. The second fan 20 is configured to receive the air A1 from the air outlet 13 of the first fan 10 into an air inlet 22 and to supply the air, represented by arrow A2, through an air outlet 23 to an environment 100. The environment 100 can include electronic components of a computer system such as a processor 101 and a heatsink 102. The first fan 10 comprises a first blade assembly 14 within a housing 11. In operation, the first blade assembly 14 rotates in a first rotational direction, represented by arrow R1. The second fan 20 comprises a second blade assembly 24 that rotates in a second rotational direction, represented by arrow R2. The second rotational direction R2 is opposite the first rotational direction R1. The first and second blade assemblies 14, 24 of this embodiment share a common axis of rotation X1, X2.

Accordingly, a method for making a fan assembly for supplying a gas flow A2 to an environment 100 includes configuring a first fan 10 to operate by rotating a fan blade assembly 14 in a first rotational direction R1 to supply a gas flow A1 to a second fan 20. The second fan 20 is configured to operate by rotating a second blade assembly 24 in a second rotational direction R2. The second rotational direction R2 is configured opposite the first rotational direction R1. The second fan 20 is further configured to receive the gas flow A1 from the first fan 10 and to supply an enhanced gas flow A2 to the environment 100.

There are several design characteristics that are important in designing a powerful and efficient redundant fan assembly 8 according to this invention. These characteristics include a pitch of each of the fan blades 16, 26, a diameter of each of the blade assemblies 14, 24, a diameter of a hub 15, 25 of each of the blade assemblies 14, 24, cupping of the fan blades 16, 26, a thickness of each of the fan blades 16, 26, a rotational speed of each of the blade assemblies 14, 24, and a gap 50 between fans, for example. By manipulating these characteristics, the fan assembly 8 can be configured to supply the cooling needs for a particular computer platform. These characteristics also determine the efficiency of redundant fan operation.

Accordingly, the method for constructing a fan assembly to supply a gas flow A2 to the environment 100 can further include configuring the second fan 20 to operate redundantly in the event of a failure of the first fan 10. The method can also include configuring the first fan 10 to operate redundantly in the event of a failure of the second fan 20. Configuring the second fan 20 to operate redundantly includes providing the first fan 10 with a blade assembly 14 comprising a minimal projected area with respect to a flow of gas drawn through the first fan by the operation of the second fan 20. Configuring the first fan 10 to operate redundantly includes providing the second fan 20 with a blade assembly 24 having a minimal projected area with respect to a flow of gas A1 created by the operation of the first fan 10. The specific design variables that are used to minimize the projected areas of the blade assemblies 14, 24 and to maximize the volume of air flow A2 to the environment 100 will now be discussed in further detail with reference to FIGS. 1–6.

Still referring to FIG. 1, each axial fan 10, 20 of the fan assembly 8 includes a fan housing 11, 21 that contains a blade assembly 14, 24. Each of the blade assemblies 14, 24 has a hub 15, 25 to which a plurality of blades 16, 26 are attached. The pitch of a fan blade 16, 26 helps control the direction and volume of the air flow through the fan 10, 20. The fan blade pitch for each of the two fans 10, 20 shown in FIG. 1 can either be uniform or non-uniform along the length of each blade 16, 26. In a presently preferred embodiment, the pitches of the blades 26 in the second blade assembly 24 are identical but reversed of the blades 16 in the first blade assembly 14. The pitches of the blades 16, 26 in the first and second blade assemblies 14, 24 can, however, be configured having different pitches with any pitch that is determined to be desirable for a particular application.

A further important characteristic of axial fans is that they do not operate well when they are choked at their inlets. This is because axial fans are much better at pushing air than pulling air. The spacing between fans 10, 20 in a serial fan assembly 8 is therefore important in promoting a maximized air flow A2. Accordingly, a sufficient sized gap 50 between the fans 10, 20 should be provided to prevent choking of the air inlet 22 into the second fan 20. A presently preferred gap 50 is approximately ½ inch.

Figure 2:
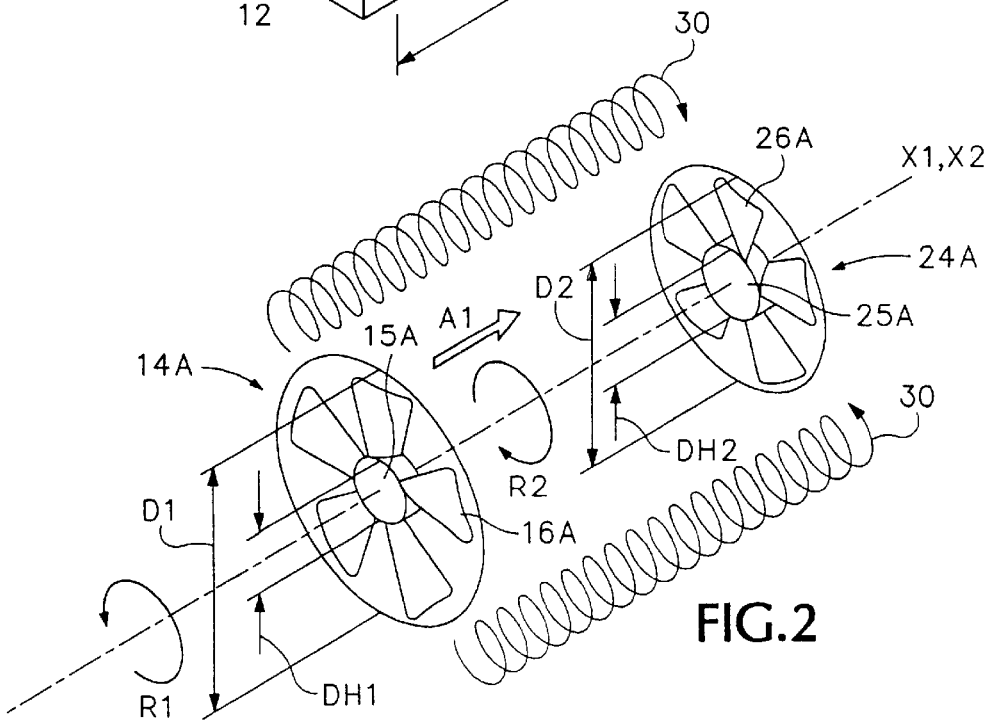
FIG. 2 is a somewhat schematic perspective view of first and second blade assemblies of a first fan and a second fan in a counter-rotating coaxial fan assembly, similar to the coaxial fan assembly of FIG. 1, showing a diameter of the second blade assembly smaller than a diameter of the first blade assembly to avoid the tip effect created by blades in the first blade assembly and showing a hub diameter of the first blade assembly smaller than a hub diameter of the second blade assembly according to a second embodiment of the present invention.

The diameter of the fan blade assemblies 14, 24 is also an important consideration. FIG. 2 is a somewhat schematic perspective view of a first and second blade assembly 14A, 24A of a counter-rotating fan assembly similar to FIG. 1, according to a second embodiment of the invention. Specifically, FIG. 2 shows a diameter D1 of the first blade assembly 14A larger than a diameter D2 of the second blade assembly 24A. During operation, fan blade tips tend to produce high-speed eddies, represented by arrows 30. Accordingly, the high-speed eddies 30 produced by the first blade assembly 14A can significantly interfere with a flow of air, represented by arrow A1 through the second blade assembly 24A. To avoid this, the diameter D2 of the second blade assembly 24A can be made smaller than a diameter D1 of the first blade assembly 14A so that the eddies 30 produced by the first fan pass outside a flow area of the second fan.

Another design variable illustrated in FIG. 2 is a diameter DH1, DH2 of each of the hubs 15A, 25A in the fan blade assemblies 14A, 24A. According to this embodiment, the hub diameter DH1 of the first blade assembly 14A is made smaller than the hub diameter DH2 of the second blade assembly 24A. Reducing the size of the first hub diameter DH1 helps to minimize the projected area of the first blade assembly 14A and therefore allows a greater volume of air A1 to be supplied to an inlet 22 of the second fan 20 when the first fan 10 is inoperative (see FIG. 1). In this way, improved redundancy is provided.

Either or both of the fan blade assemblies 14A, 24A can also have fan blades 16A, 26A which are cupped to further control the flow characteristics of the fans. The trailing edge of the blade, for instance, can be hooked to provide a greater rake angle at the end, and/or the rake angle can be varied along the blade. If manipulated properly, this can provide additional benefits in fluid transfer between fans.

Figure 3A:
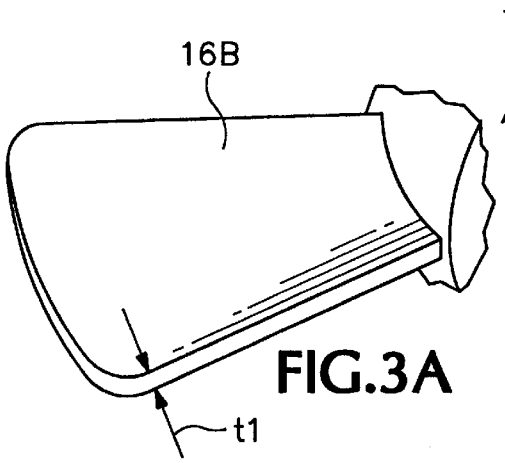
FIGS. 3A and 3B are somewhat schematic exploded perspective views of a blade in a first blade assembly and a blade in a second blade assembly, respectively, similar to the blade assemblies of FIG. 2, showing the blades having an identical but reversed pitch from each other, and showing a thickness of the blade in the first blade assembly greater than a thickness of the blade in the second blade assembly according to a third embodiment of the present invention.
Figure 3B:
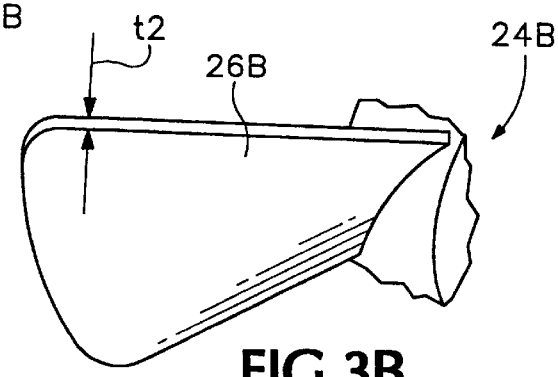

FIGS. 3A and 3B illustrate still other characteristics of the present invention, according to a third embodiment. Specifically, FIGS. 3A and 3*b* include somewhat schematic exploded perspective views of a fan blade 16B, 26B of each of the first and second blade assemblies 14B, 24B, respectively. The pitches of the fan blades 16B, 26B can be made exactly the reverse of each other to promote air flow transfer between the fans when both fans are operating. This design also results in improved redundancy if one of the fans should fail or become disabled. This improved redundancy results from each fan having a minimal projected area relative to a directional air flow created or induced by the other fan.

To further enhance the redundancy and air flow characteristics in this invention, blades 16B of the second blade assembly 24B preferably have a blade thickness t2 that is smaller than a blade thickness t1 of the first blade assembly 14B. The blades 16B of the first blade assembly 14B can thereby be made of cheaper material such as plastic, while the blades 26B of the second blade assembly 24B are made of a stronger plastic or a metal. By providing blades 26B having a reduced thickness, the second blade assembly 24B is configured with a minimal projected area. A smaller projected area creates less of an obstruction for air flow A1 from the first blade assembly 14B. This configuration also reduces an amount of back pressure created by rotation of the second blade assembly 24B.

Figure 4:
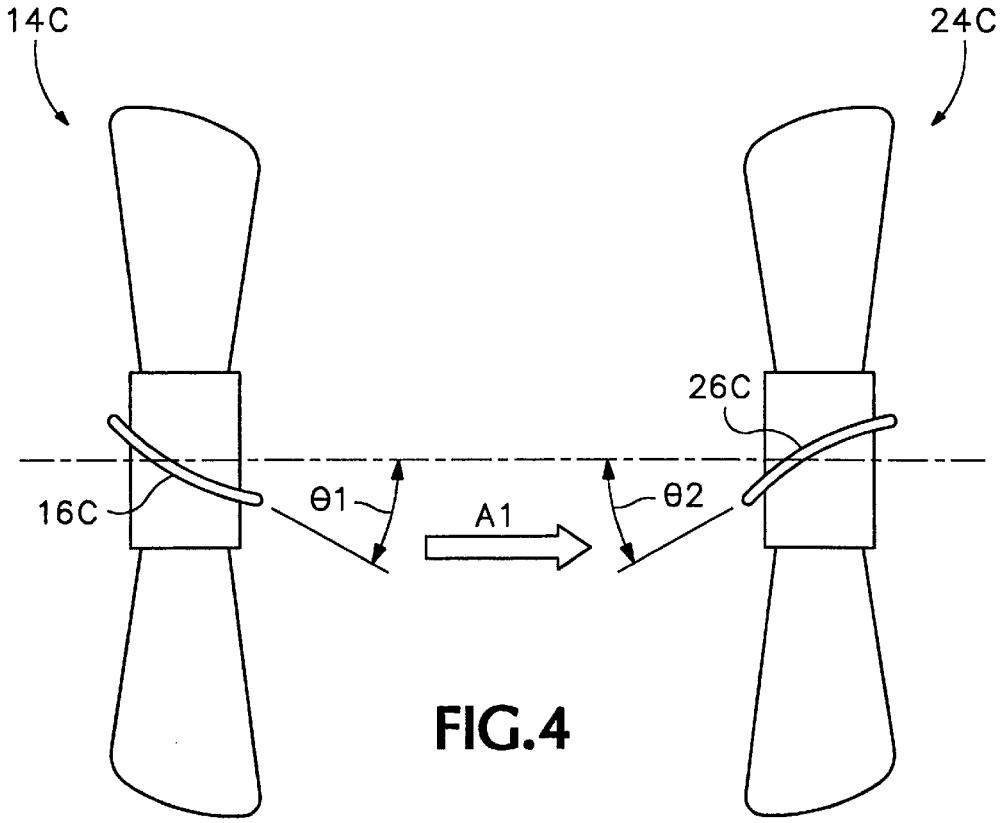
FIG. 4 is a somewhat schematic side elevation view of a first and second blade assembly, similar to FIG. 2, according to a fourth embodiment of the present invention, in which a rake angle of each of the blades of the second blade assembly is equal to a blow angle of each of the blades of the first blade assembly.

FIG. 4 is a somewhat schematic side elevation view of a first and second blade assembly 14C, 24C according to a fourth embodiment of the present invention. According to the fourth embodiment shown in FIG. 4, a rake angle θ2 of each of the blades 26C of the second blade assembly 24C is equal to a blow angle θ1 of each of the blades 16C of the first blade assembly 14C. This configuration enhances a flow of air A1 between the first and second blade assemblies 14C, 24C. Also, by configuring a rake angle θ2 of the blades 26C in the second blade assembly 24C to equal a blow angle θ1 of the blades 16C in the first blade assembly 14C, the projected area of the second blade assembly 24C can be minimized with respect to the air flow A1 created by the first blade assembly 14C.

Figure 5A:
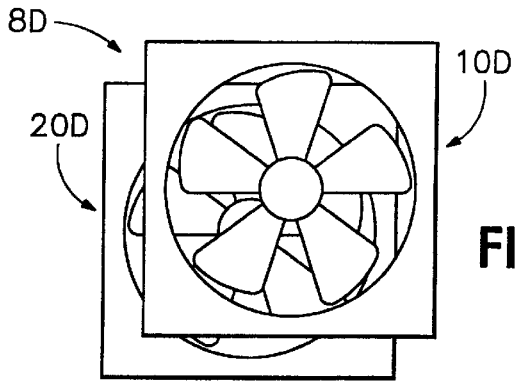
FIGS. 5A, 5B and 5C include, respectively, somewhat schematic front, side, and top elevation views of a counter-rotating fan assembly similar to FIG. 1, according to a fifth embodiment of the present invention, wherein an axis of rotation of the second fan is slightly offset from an axis of rotation of the first fan to compensate for a drift of the air exiting the first fan.
Figure 5B:
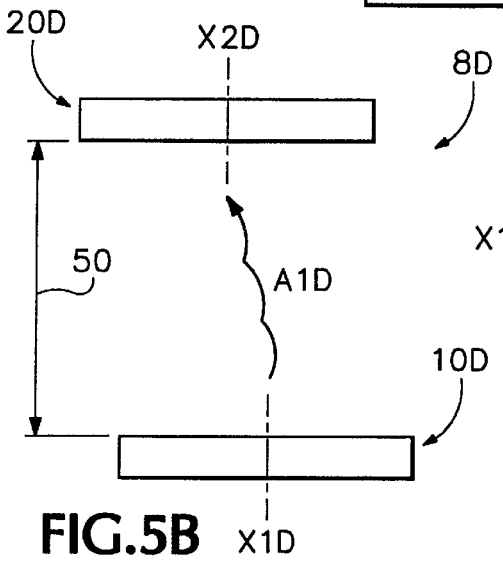
Figure 5C:
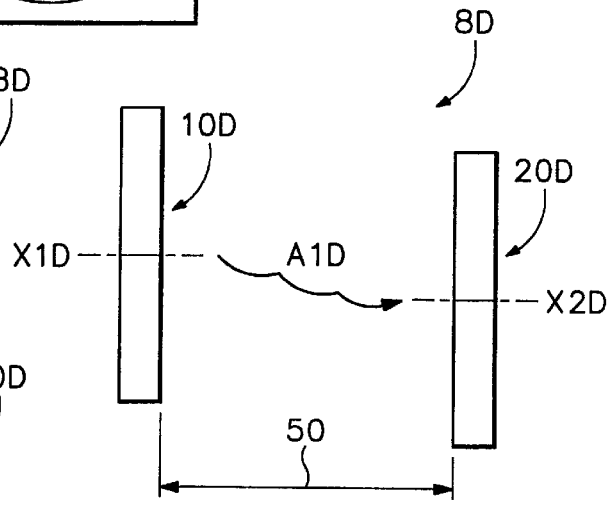

FIGS. 5A, 5B, and 5C are, respectively, a front elevation, a top plan, and a side elevation view of a counter-rotating serial fan assembly 8D, similar to that shown in FIG. 1, according to a fifth embodiment of the present invention. As illustrated by FIGS. 5A–5C, in some applications, it may be desirable to provide offset axes of rotation X1D, X2D between the first and second fans 10D, 20D. Particularly, because air exiting an axial fan 10D tends to drift away from the axis and "walk off" in a spiral-like fashion, the fans 10D, 20D can be configured so that their axes X1D, X2D are slightly offset in either a vertical or horizontal direction, or both (as in this embodiment), to compensate for this effect.

Figure 6:
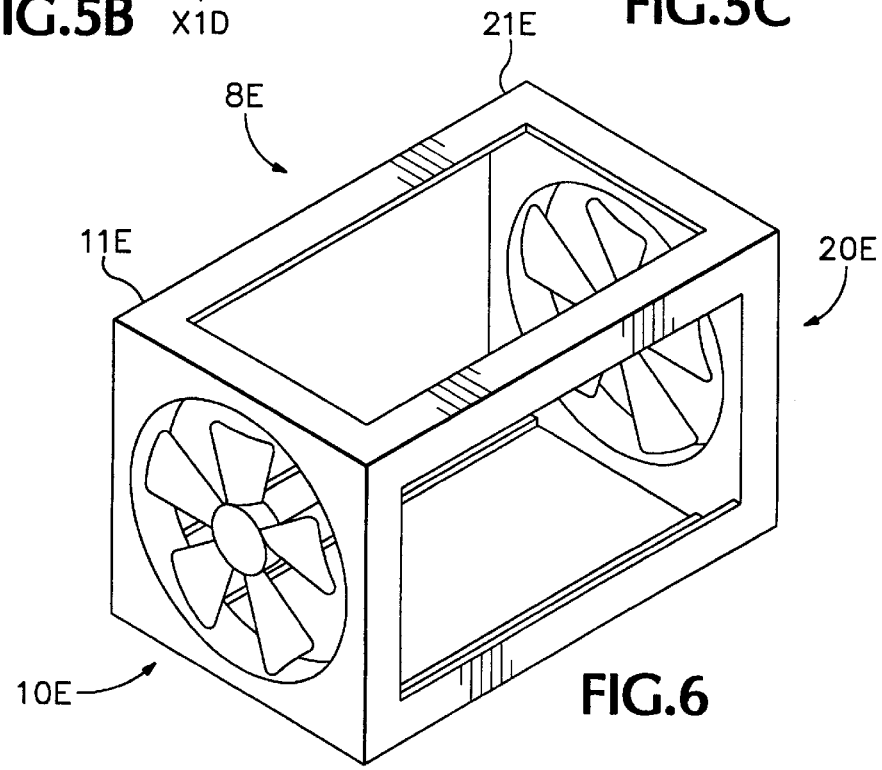
FIG. 6 is a somewhat schematic perspective view of a counter-rotating fan assembly similar to FIG. 1, according to yet another embodiment of the present invention, wherein a housing of the first fan and a housing of the second fan are formed integrally.

FIG. 6 is a perspective view of a counter-rotating fan assembly 8E, similar to FIG. 1, showing a sixth embodiment of the present invention. Referring to FIG. 6, a housing 11E of the first fan 10E and a housing 21E of the second fan 20E can be formed integrally. The integral formation of the fan housings 11E, 21E may simplify the manufacture of the counter-rotating fan assembly 8E and thereby help reduce manufacturing costs. Furthermore, it may be desirable to have the housing formed with an open side, sides, top, bottom, or any combination thereof, to reduce choking at the inlet of the second fan 20E. More particularly, in a closed housing, when the first fan 10E is operational, it acts as a jet and forces air into the second fan 20E. If the first fan 10E dies out, however, the closed sides restrict the airflow available to the second fan 20E, thus choking the second fan's air inlet. Openings in the housing allow more air to enter the second fan 20E when the first fan 10E is inoperable, and, consequently, significantly reduce choking of the second fan's inlet. As illustrated in FIG. 6, it is most preferable to have the top, bottom, and sides open to allow a maximum amount of air to be supplied to the second fan 20E.

Referring again to FIG. 1, other characteristics of the fan assembly 8 can be modified to enhance the characteristics of the invention. For example, another relevant design consideration is a rotational speed ratio between the fan blade assemblies 14, 24. Rotational speeds, typically measured in revolutions per minute (rpm), can be the same for both fans 10, 20, or different for each fan. In some instances, it may be desirable to have a speed ratio between the two fans 10, 20 that is controllable. The rotational speed of a fan can be controlled, for instance, by changing a voltage supplied to it. When separate voltages are supplied to the counter-rotating fans of this invention, their rotational speeds can be controlled separately. A potentiometer can be connected to an incoming voltage supply of one or both of the fans 10, 20 to throttle the fan speed and thereby control the speed ratio between the fans 10, 20.

Other possible features of the fan assembly 8 of this invention include control of an on time and an off time of the fans 10, 20. Control of the fans' on and off times can be based on a temperature of an electronic component(s), on an amount of power consumption of an electronic component (s) within the environment, or on noise control considerations.

One example of control of the on and off times of the fans based on the temperature of component(s) in the environment (such as a computer platform) proceeds as follows. Initially, only the first fan 10 is turned on when the computer system is turned on. Once a threshold temperature is reached within one or more of the electronic components (such as a processor (CPU) 101, a heat sink 102, or an FET (not shown)), the second fan 20 is turned on (i.e., by the CPU). The second fan 20 can be configured to turn off again once the temperature drops a certain amount below the threshold temperature.

Power control of the fans' on and off times is also possible. Power control can be based simply on current flow to the electronic components when the voltage is constant. In a power controlled fan assembly 8, only the first fan 10 operates until a threshold power level is reached. Once the electronic component(s) begin consuming power above the threshold level, the second fan 20 is turned on. When the power consumption drops below that threshold level (or a specified amount below the threshold level) the second fan 20 can be turned off again.

The on and off times of the fans 10, 20 can also be controlled to reduce an amount of noise produced by the system. The suspension of fan operation could take place automatically or at a user's request. For instance, a computer using the fan assembly 8 of this invention could detect an incoming phone call and temporarily suspend operation of one or both of the fans 10, 20 to reduce an amount of noise created by the computer while the telephone is in use. The user could also be allowed to selectively suspend fan operation to reduce noise output for other reasons, such as to listen to music, to talk to someone, etc.

As can be seen from the previous discussion, there are many different factors that are considered important for achieving the goals of this invention. All of the characteristics of the fans described above can be manipulated independently and combined in any number of ways to create the best configuration for a particular application. Nevertheless, the specific design configurations according to the best mode presently contemplated by the inventor are described below.

With reference to each of the above FIGS. 1–6, and according to the presently conceived best mode, the diameter D2 of the second blade assembly 24A is smaller than the diameter D1 of the first blade assembly 14A to avoid the tip effect from the blades 16A in the first fan 10. The second fan 20 also has a blade pitch that is described by the airflow from the first fan (i.e., the blow angles θ1 of the blades 16C in the first blade assembly 14C are equal to the rake angles θ2 of the blades 26C in the second blade assembly 24C). Additionally, a gap 50 between the first and second fans 10, 20 is approximately ½ inch. Both fans 10, 20 are configured to operate at the same rotational speed, although the rpm ratio between them is preferably made easily controllable by providing a potentiometer to control the voltage into at least one of the fans 10, 20. It is also preferable to provide an offset axis of rotation X1, X2 between the first and second fans 10, 20 to accommodate for air drift.

Having described and illustrated the principles of the invention in multiple embodiments thereof, it should be apparent that the invention can be modified in arrangement and detail without departing from its principles. I therefore claim all modifications and variations coming within the spirit and scope of the following claims.

What is claimed is:

1. A fan assembly for cooling an environment of a computer housing, said fan assembly comprising:

a plurality of counter-rotating fans comprising a first fan and a second fan arranged in series;

said first fan comprising a first blade assembly having a first blade assembly diameter and a plurality of first blades, said first fan further comprising a first hub having a first hub diameter;

said second fan comprising a second blade assembly having a second blade assembly diameter and a plurality of second blades, said second fan further comprising a second hub having a second hub diameter;

wherein said first blade assembly diameter is larger than said second blade assembly diameter; and wherein said first hub diameter is smaller than said second hub diameter.

2. A fan assembly according to claim 1, wherein an on and off time of at least one of the fans is independently controllable.

3. A fan assembly according to claim 2, wherein the on and off time is controlled based on a temperature of an environment being cooled by the fans.

4. A fan assembly according to claim 1, wherein an axis of rotation of the first fan is offset from an axis of rotation of the second fan.

5. A fan assembly according to claim 1, further comprising a housing that integrally houses the first and second fans.

6. A fan assembly according to claim 5, wherein the housing comprises one or more open sides.

* * * * *